US010328696B2

(12) United States Patent
Ishii et al.

(10) Patent No.: US 10,328,696 B2
(45) Date of Patent: Jun. 25, 2019

(54) LIQUID EJECTION HEAD

(71) Applicant: CANON KABUSHIKI KAISHA, Tokyo (JP)

(72) Inventors: Kazuhiro Ishii, Yokohama (JP); Junichiro Iri, Yokohama (JP); Ryo Sato, Yokohama (JP); Hiroyuki Shimoyama, Kawasaki (JP); Kazumasa Matsushita, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/692,576

(22) Filed: Aug. 31, 2017

(65) Prior Publication Data

US 2018/0065366 A1 Mar. 8, 2018

(30) Foreign Application Priority Data

Sep. 6, 2016 (JP) ..... 2016-173601

(51) Int. Cl.
*B41J 2/14* (2006.01)

(52) U.S. Cl.
CPC .. *B41J 2/14209* (2013.01); *B41J 2002/14217* (2013.01); *B41J 2002/14225* (2013.01); *B41J 2002/14306* (2013.01); *B41J 2202/18* (2013.01); *B41J 2202/20* (2013.01)

(58) Field of Classification Search
None
See application file for complete search history.

(56) References Cited

U.S. PATENT DOCUMENTS

2006/0232641 A1* 10/2006 Sugahara ..... B41J 2/14233 347/70
2007/0216728 A1* 9/2007 Ito ..... B41J 2/14209 347/48
2011/0102520 A1* 5/2011 Kim ..... B41J 2/14233 347/85
2011/0122207 A1* 5/2011 Shin ..... B41J 2/14233 347/85

FOREIGN PATENT DOCUMENTS

JP 2001-162796 A 6/2001
JP 2001-260349 A 9/2001

* cited by examiner

*Primary Examiner* — Erica S Lin
(74) *Attorney, Agent, or Firm* — Canon U.S.A., Inc. IP Division

(57) ABSTRACT

A liquid ejection head includes a plurality of ejection ports, a plurality of pressure chambers each communicating with each of the ejection ports, a piezoelectric actuator constituting part of walls of the pressure chambers, and a common liquid chamber containing liquid to be supplied to the pressure chambers. The pressure chambers and the common liquid chamber are opposed with an opposing wall interposed therebetween. The opposing wall faces the wall of the pressure chambers constituted by the piezoelectric actuator. A reinforcing portion that supports the opposing wall is provided in the common liquid chamber.

9 Claims, 14 Drawing Sheets

LIQUID EJECTION HEAD

BACKGROUND OF THE INVENTION

Field of the Invention

The present disclosure relates to a liquid ejection head.

Description of the Related Art

A known example of the configuration of a piezoelectric liquid ejection head is such that a plate-like piezoelectric actuator is joined to a substrate (a cavity plate) in which a plurality of pressure chambers and ejection ports are formed (Japanese Patent Laid-Open No. 2001-162796 and No. 2001-260349). A piezoelectric actuator having a structure in which piezoelectric layers are laminated is joined to a substrate so as to cover the openings of pressure chambers provided in the substrate. A plurality of ejection ports communicating with the individual pressure chambers are open from a surface of the substrate different from a surface to which the piezoelectric actuator is joined. In this configuration, one wall of each pressure chamber is constituted by the piezoelectric actuator. The capacity of the pressure chambers is reduced by piezoelectric deformation of the piezoelectric actuator, thereby causing the liquid in the pressure chambers to be ejected from the ejection ports to the outside.

In the configuration disclosed in Japanese Patent Laid-Open No. 2001-162796, the pressure chambers are open from one surface of the substrate, to which the plate-like piezoelectric actuator is joined so as to cover the openings of the pressure chambers. The substrate has a multilayer structure in which a plurality of plate members (plates) are laminated. Of these plates, a base plate has through holes serving as pressure chambers, and the piezoelectric actuator is joined to one surface of the base plate. A spacer plate is joined to a surface of the base plate opposite to the surface to which the piezoelectric actuator is joined. Two manifold plates each have a through hole that constitutes a common liquid chamber and are joined to a surface of the spacer plate opposite to a surface joined to the base plate. An ejection port plate (an ejection-port formed member) is joined to the manifold plates to cover the through hole and has ejection ports. Each plate has channels connecting the common liquid chamber and the pressure chambers, channels connecting the pressure chambers to the ejection ports, and channels connecting a liquid supply source (not shown) to the common liquid chamber. In this configuration, liquid flows among the plates. In other words, the liquid from the liquid supply source is stored in the common liquid chamber, from which the liquid is supplied to the pressure chambers through the channels. When the piezoelectric actuator is deformed, so that the capacities of the pressure chambers are reduced, the liquid in the pressure chambers is ejected from the ejection ports through the channels.

The substrate with a structure disclosed in Japanese Patent Laid-Open No. 2001-162796 has a plurality of recesses on a first surface of the plate-like ejection-port formed member and has a plurality of ejection ports that are open from a second surface of the election-port formed member so as to communicate with the recesses. The plate-like piezoelectric actuator is joined to the first surface of the ejection-port formed member to close the recesses to form the pressure chambers. The pressure chambers and the election ports are arranged in a plurality of arrays. Adjacent pressure chambers are partitioned by a thin partition wall in the arrangement direction.

In the configuration disclosed in Japanese Patent Laid-Open No. 2001-20349, the piezoelectric actuator constitutes one wall of each pressure chamber, and the common liquid chamber is disposed at a position opposing the piezoelectric actuator with one plate (wall) interposed therebetween. With this configuration, when the piezoelectric actuator is deformed so as to protrude toward the inside of the pressure chambers, pressure due to the deformation can push a wall (referred to as "opposing wall") at a position opposing the piezoelectric actuator to deform the wall. In particular, the common liquid chamber is positioned on the back of the opposing wall as viewed from the pressure chambers, so that the opposing wall is not firmly supported, being easily deformed by the pressure generated by the piezoelectric actuator. The deformation of the opposing wall can decrease the amount of reduction in the capacities of the pressure chambers, possibly not providing sufficient pressure to satisfactorily eject the liquid. In other words, part of energy generated by the piezoelectric actuator is used for deformation of the opposing wall rather than liquid ejection, resulting in poor energy efficiency. In addition, the deformation of the opposing wall also causes pressure to the liquid in the common liquid chamber, which applies pressure to the liquid in the other pressure chambers via the liquid in the common liquid chamber, possibly causing crosstalk.

Furthermore, in the case where adjacent pressure chambers are partitioned by a thin partition wall, as disclosed in Japanese Patent Laid-Open No. 2001-260349, the pressure due to the deformation of the piezoelectric actuator can deform the thin partition wall, causing pressure to be applied also to the liquid in the adjacent pressure chamber. The generation of crosstalk causes part of the energy generated by the piezoelectric actuator to be used for deformation of the partition wall, resulting in poor energy efficiency. Furthermore, when the Liquid in the adjacent pressure chamber vibrates and is thereafter ejected from the adjacent pressure chamber, the vibrating liquid cannot exhibit desired behavior, which may decrease the accuracy of liquid ejection. Furthermore, in some cases, the liquid may be ejected or dropped from the ejection ports even though a piezoelectric actuator at a position facing the adjacent pressure chamber is not operated. Increasing the thickness of a partition wall between adjacent pressure chambers to prevent crosstalk increases the size of the entire liquid ejection head, which is undesirable because it hinders high density.

SUMMARY OF THE INVENTION

The present disclosure provides a liquid ejection head capable of high-accuracy liquid ejection with high energy efficiency.

A liquid ejection head according to an aspect of the present disclosure includes a plurality of ejection ports, a plurality of pressure chambers each communicating with each of the ejection ports, a piezoelectric actuator constituting part of walls of the pressure chambers, and a common liquid chamber containing liquid to be supplied to the pressure chambers. The pressure chambers and the common liquid chamber are opposed with an opposing wall interposed therebetween. The opposing wall faces the wall of the pressure chambers constituted by the piezoelectric actuator. A reinforcing portion that supports the opposing wall is provided in the common liquid chamber.

Further features of the present disclosure will become apparent from the following description of exemplary embodiments with reference to the attached drawings.

DESCRIPTION OF THE EMBODIMENTS

Embodiments of the present disclosure will be described with reference to the drawings.

Basic Structure of Liquid Ejection Head

Figure 1:
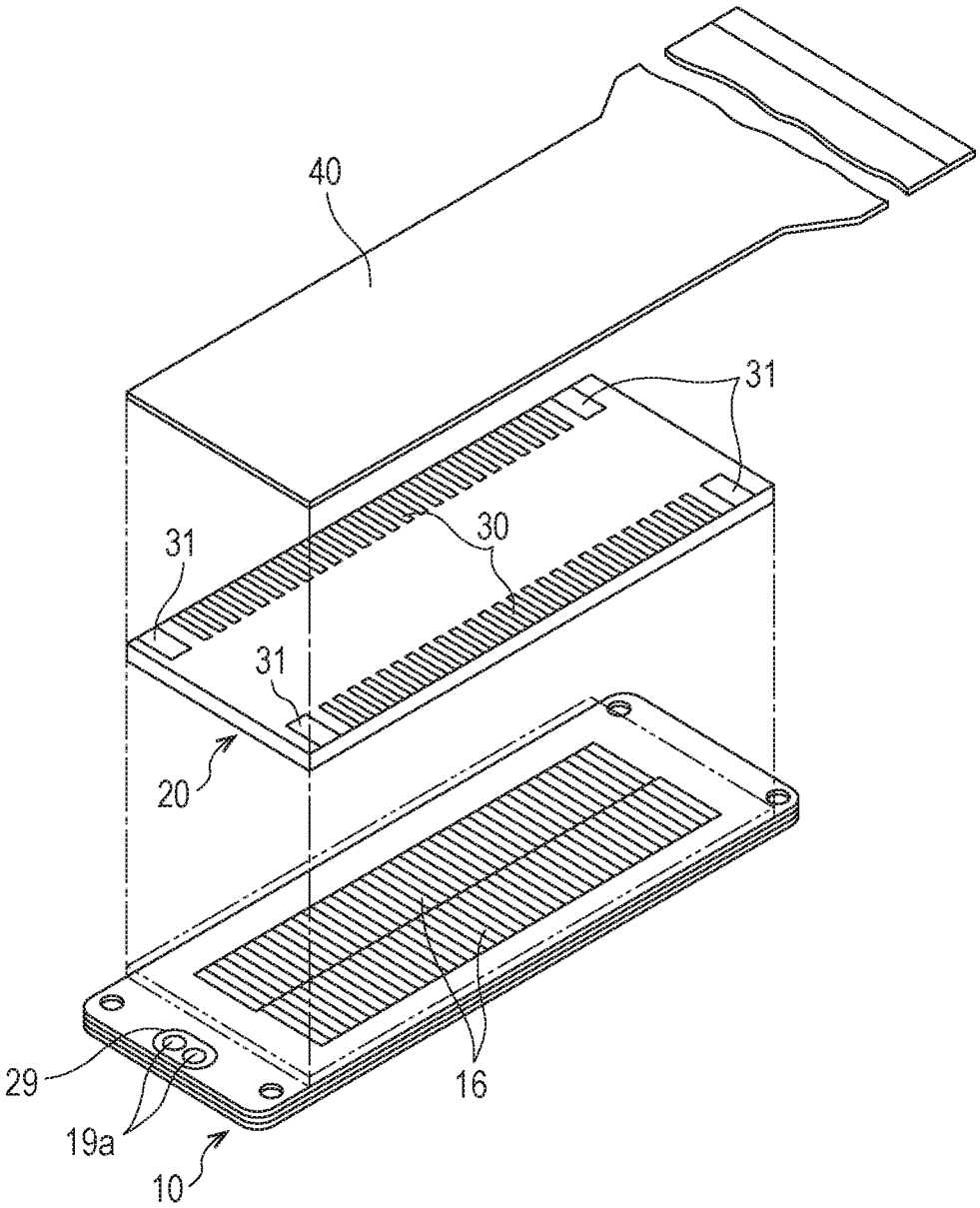
FIG. 1 is an exploded perspective view of a liquid ejection head according to a first embodiment of the present disclosure.
Figure 2:
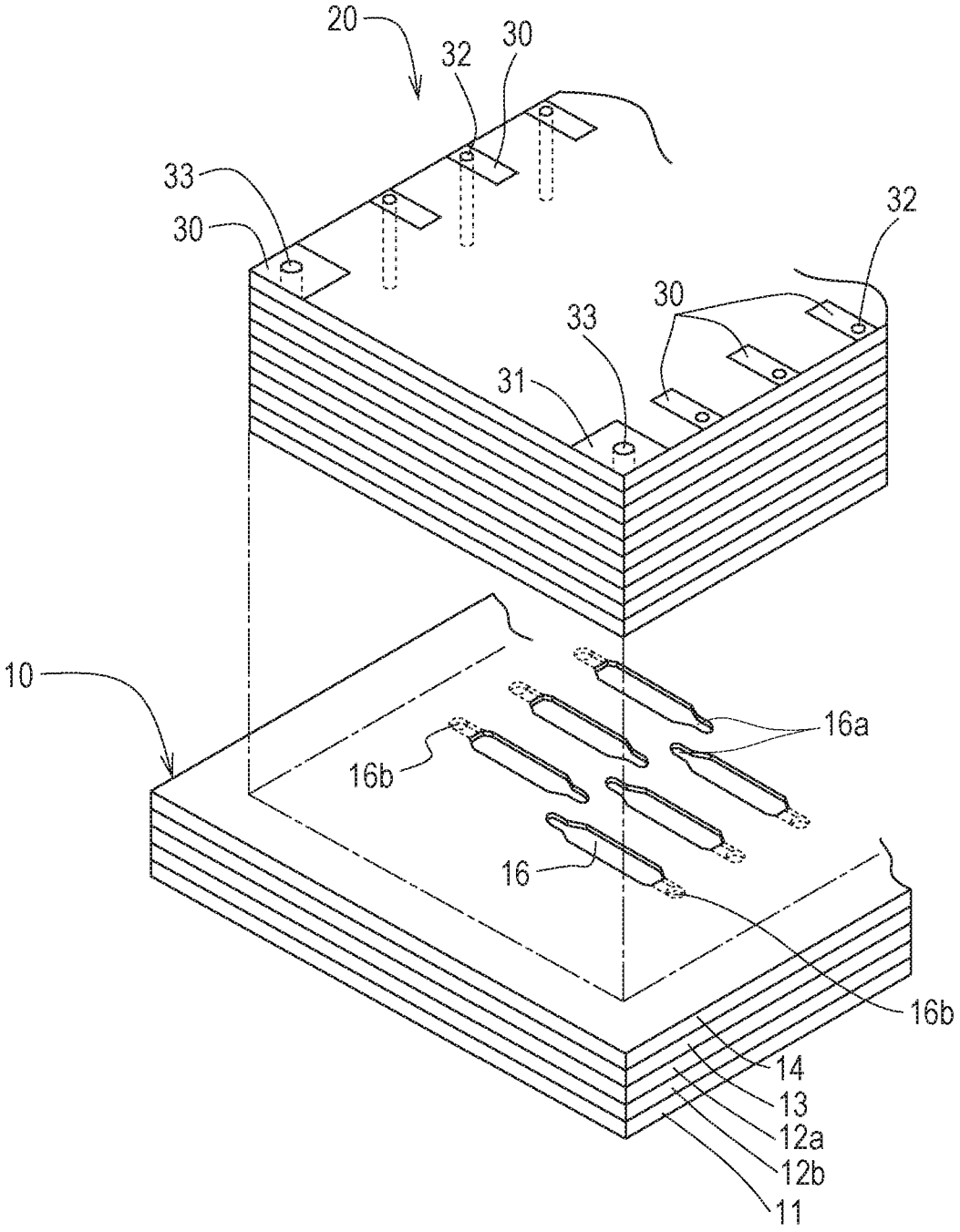
FIG. 2 is an exploded perspective view of a substrate and a piezoelectric actuator of the liquid ejection head in FIG. 1.

FIG. 1 illustrates the basic structure of a liquid ejection head according to a first embodiment of the present disclosure. This liquid ejection head has a configuration in which a piezoelectric actuator 20 is joined to a substrate (a cavity unit) 10. Furthermore, an electrical wiring member (flexible flat cable) 40 for connection with an external device is overlaid and joined to the piezoelectric actuator 20. Ejection ports are open in the lowermost surface of the substrate 10 in FIG. 1, from which liquid (for example, liquid ink) is elected.

Substrate

As illustrated in FIGS. 2 to 5, the substrate 10 of the present embodiment has a structure in which five thin plate members (plates) of an ejection-port formed member (an ejection port plate, or a first plate) 11, two manifold plates 12*a* (a third plate) and 12*b* (a fourth plate), a spacer plate 13, and a base plate 14 (a second plate) are laminated. In one example, the ejection-port formed member 11 is made of synthetic resin, and the other plates 12*a*, 12*b*, 13, and 14 are made of a 42% nickel alloy steel plate with a thickness of about 50 μm to 250 μm (a longitudinal elasticity modulus of 147 GPa). The ejection-port formed member 11 has many minute-diameter ejection ports 15 for ejecting ink at minute intervals. The ejection ports 15 are disposed in two rows in a staggered arrangement along the long sides (a first direction) of the ejection-port formed member 11.

Figure 3:
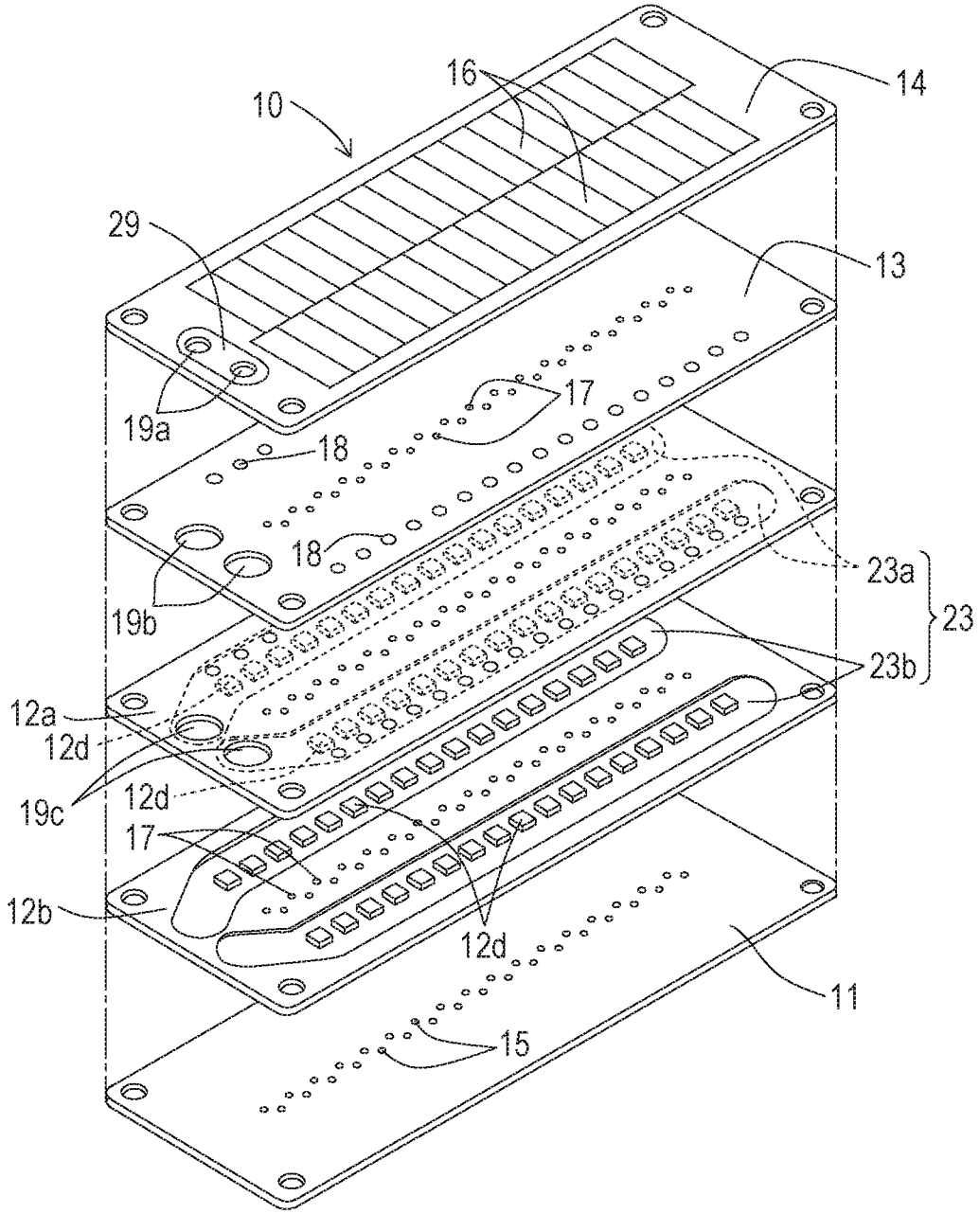
FIG. 3 is an exploded perspective view of the substrate of the liquid ejection head in FIG. 1.
Figure 4:
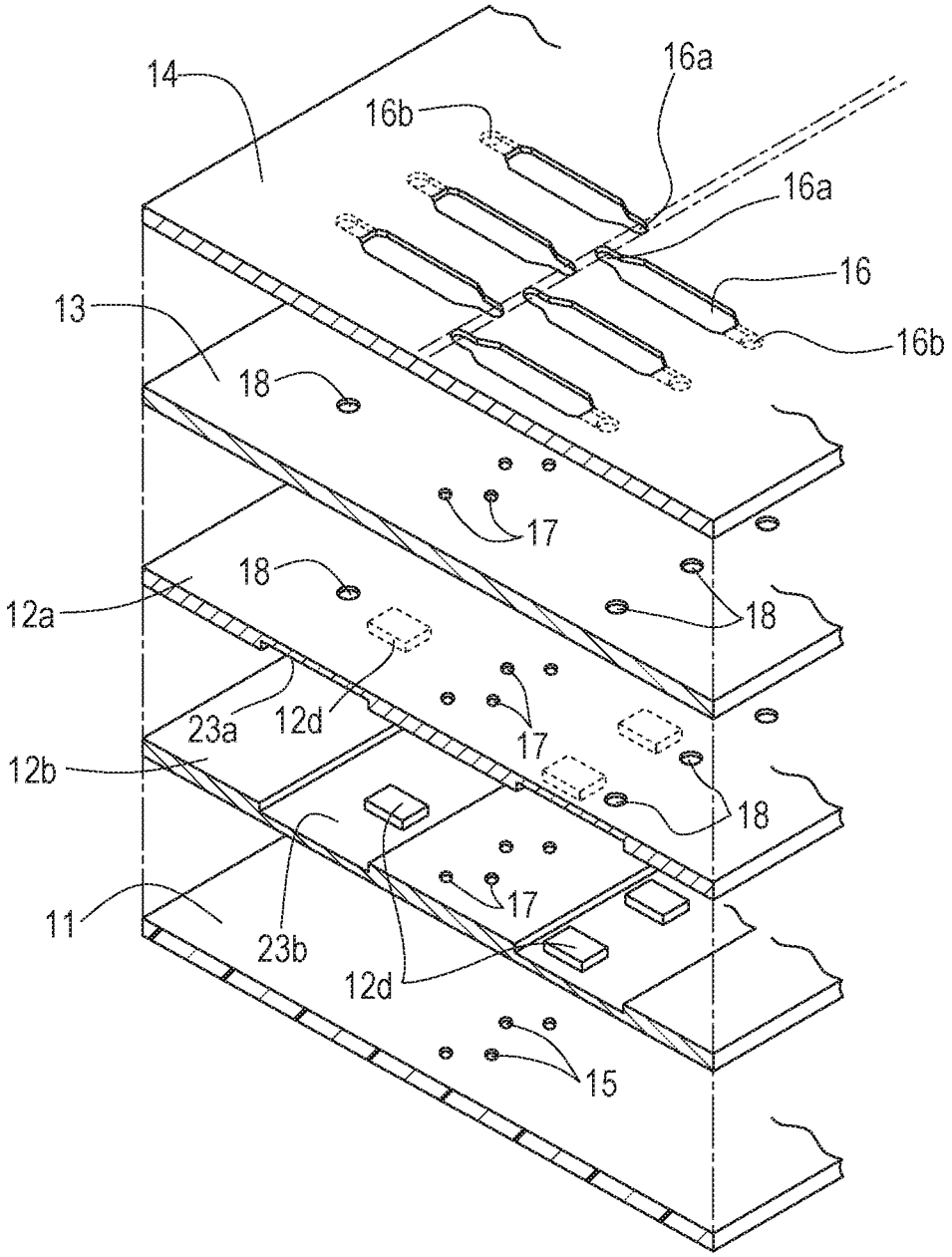
FIG. 4 is a partly cut-away exploded perspective view of the substrate illustrating a relevant part in FIG. 3 in enlarged view.
Figure 5:
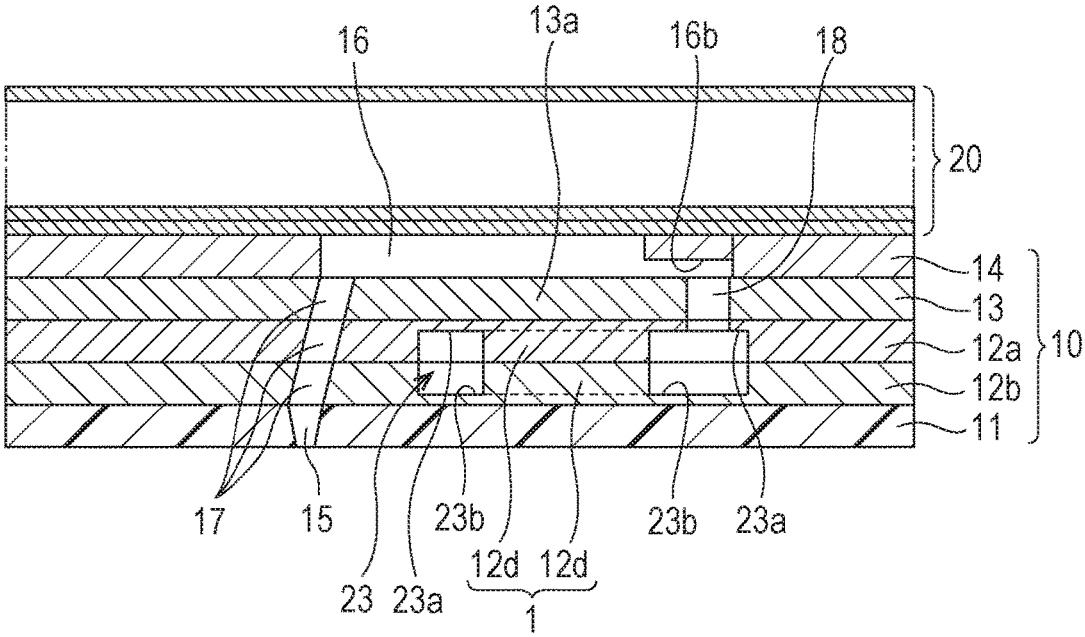
FIG. 5 is a cross-sectional view of the liquid ejection head in FIG. 1.

As illustrated in FIGS. 3 to 5, the two manifold plates 12*a* and 12*b* are provided with common liquid chambers 23 extending substantially along the long sides of the manifold plates 12*a* and 12*b*. The common liquid chambers 23 are positioned so as to sandwich the rows of the ejection ports 15, described above, from both sides in the short side direction. The upper manifold plate 12*a* has recesses 23*a* that are open from the lower surface, and the lower manifold plate 12*b* has recesses 23*b* that are open from the upper surface. The manifold plates 12*a* and 12*b* are laminated so that the openings of the recesses 23*a* and 23*b* face each other to constitute the common liquid chambers 23. The common liquid chambers 23 are connected to a plurality of pressure chambers 16 via through holes 18, described later. Protrusions 12*d* are respectively provided in the recesses 23*a* and 23*b*. An end of each protrusion 12*d* in the recess 23*a* and an end of each protrusion 12*d* in the recess 23*b* come into contact and join together to constitute a reinforcing portion 1 (the protrusion 12*d*).

As illustrated in FIGS. 3 and 4, the plurality of pressure chambers 16 are provided in the base plate 14 in two rows in a staggered arrangement along the long sides (in the first direction, described above) of the base plate 14. Each pressure chamber 16 is formed in an elongated shape so that its longitudinal direction is orthogonal to the longitudinal direction of the base plate 14. A first end 16*a* of each pressure chamber 16 is positioned substantially at the center of the base plate 14 in the short side direction. The first ends 16*a* are disposed in a staggered arrangement like minute-diameter through holes 17 in the spacer plate 13 and the two manifold plates 12*a* and 12*b*. The first ends 16*a* communicate with the staggered ejection ports 15 of the ejection-port formed member 11 through the through holes 17 serving as liquid channels. A second end 16*b* of each pressure chamber 16 is formed as a recess that is open downwards, as illustrated in FIG. 4. The second ends 16*b* communicate with the common liquid chambers 23 of the manifold plates 12*a* and 12*b* via through holes 18 provided on the right and left sides of the spacer plate 13. Supply holes 19*a* (see FIG. 3) provided at one end of the uppermost base plate 14 of the substrate 10 communicate with the common liquid chambers 23 via through holes 19*b* of the spacer plate 13 and through holes 19*c* of the upper manifold plate 12*a*. The supply holes 19*a* are provided with a filter 29 for removing dust in liquid supplied from an liquid tank (not shown) disposed above. The pressure chambers 16 are disposed such that their longitudinal direction are orthogonal to the longitudinal direction of the common liquid chamber 23.

As described above, the substrate 10 of the present embodiment is configured such that liquid flows from the supply holes 19*a* provided at one end of the base plate 14 through the through holes 19*b* and 19*c* into the common liquid chambers 23. The liquid in the common liquid chambers 23 is distributed into the pressure chambers 16 through the through holes 18, and thereafter flows from the pressure chambers 16 through the through holes 17 to reach the election ports 15 corresponding to the pressure chambers 16 (see FIGS. 3 to 5). The uppermost base plate 14 of the substrate 10 has groove-like recesses constituting the pressure chambers 16, and the recesses are open upward, as described above. The piezoelectric actuator 20 is laminated on the base plate 14, so that the openings of the recesses are closed by the piezoelectric actuator 20 to constitute the pressure chambers 16.

Operation and Configuration of Liquid Ejection

In the liquid ejection head of the present embodiment, the pressure chambers 16 of the substrate 10 are closed by the piezoelectric actuator 20. In other words, part of the walls of each pressure chamber 16 is constituted by the piezoelectric actuator 20. Accordingly, when electric power is appropriately supplied from an electrode (to be described later) to the piezoelectric actuator 20, the piezoelectric actuator 20 is deformed in a protruding shape toward the inside of the pressure chamber 16, that is, so as to reduce the capacity of the pressure chamber 16. This causes pressure to be applied to the liquid in the pressure chamber 16, and the liquid is ejected to the outside through the through hole 17 from the ejection port 15. When the piezoelectric actuator 20 is deformed toward the inside of the pressure chambers 16 to reduce the capacity in this manner, the pressure is also applied through the liquid to the other walls of the pressure chamber 16 other than the wall constituted by the piezoelectric actuator 20. In particular, a pressure in a direction perpendicular to a wall at a position facing the piezoelectric actuator 20 (part of the spacer plate 13, referred to as "opposing wall 13*a*") is applied to the opposing wall 13*a*. If the opposing wall 13*a* is deformed by the pressure, the amount of reduction in the capacity of the pressure chamber 16 is decreased, resulting in poor energy efficiency, and in some cases, the capacity is not reduced enough to eject the liquid from the ejection port 15. In addition, the deformation of the opposing wall 13*a* can draw the base plate 14 constituting the side walls of the pressure chamber 16 to deform the base plate 14. In particular, deformation of a thin partition wall positioned between adjacent pressure chambers 16 out of the side walls of the pressure chambers 16 that the base plate 14 constitutes can cause so-called crosstalk in which the liquid in pressure chambers 16 that do not eject liquid is also influenced by the vibration and so on. The deformation of the opposing wall 13*a* of the pressure chamber 16 is likely to occur due to the fact that the pressure chamber 16 and the common liquid chamber 23 are opposed to each other with the opposing wall 13*a* interposed therebetween, that is, the fact that the common liquid chamber 23 is positioned on the back of the opposing wall 13*a* as viewed from the inside of the pressure chamber 16, so that a firmly supporting member is not present. The deformation of the opposing wall 13*a* can cause the pressure to be applied also to the liquid in the common liquid chamber 23 and also to the liquid in other pressure chambers 16 via the liquid in the common liquid chamber 23, possibly causing crosstalk.

For that reason, the present disclosure is configured such that deformation of the opposing wall 13*a* hardly occurs by disposing the reinforcing portion 1 constituted by the protrusion 12 in the common liquid chamber 23, and supporting the opposing wall 13*a* from the back with the reinforcing portion 1. Specifically, the common liquid chamber 23 of the present embodiment is formed of two manifold plates 12*a* and 12*b* laminated each other. The manifold plates 12*a* and 12*b* are overlapped with one another so that the recess 23*a* that is open from one surface of the manifold plate 12*a* and the recess 23*b* that is open from one surface of the manifold plate 12*b* face each other. The recesses 23*a* and 23*b* face each other to form the common liquid chamber 23. The protrusion 12*d* protruding toward the opposite manifold plate 12*a* or 12*b* is provided in each of the recesses 23*a* and 23*b*. When the manifold plates 12*a* and 12*b* are laminated, the ends of the protrusions 12*d* are brought into contact with each other to constitute the columnar reinforcing portion 1 standing in the common liquid chamber 23.

With this configuration, even if pressure is applied to the opposing wall 13*a* via the liquid when the piezoelectric actuator 20 constituting one wall of the pressure chamber 16 is deformed, the opposing wall 13*a* is hardly deformed. This is because the reinforcing portion 1 in the common liquid chamber 23 positioned on the back of the opposing wall 13*a* as viewed from the pressure chamber 16 supports the opposing wall 13*a*. Since the opposing wall 13*a* is hardly deformed, almost all of the energy generated by the piezoelectric actuator 20 is used to reduce the capacity of the pressure chamber 16, which is energy efficient, allowing the liquid in the pressure chamber 16 to be satisfactorily ejected from the ejection ports 15 to the outside. Furthermore, in the present embodiment, the common liquid chamber 23 is constituted by providing the bottomed recesses 23*a* and 23*b* in the manifold plates 12*a* and 12*b* rather than by providing through holes in the manifold plates 12*a* and 12*b*. In other words, the common liquid chamber 23 is not positioned on the back of the opposing wall 13*a* as viewed from the pressure chamber 16 but is positioned with part (a thin portion) of the manifold plate 12*a* interposed therebetween. Accordingly, part (the thin portion) of the manifold plate 12*a* also supports the opposing wall 13*a* of the pressure chamber 16, contributing to suppression of deformation.

Furthermore, in the present embodiment, the opposing wall 13*a* of the pressure chamber 16 is hardly deformed, so that there is little possibility of occurrence of crosstalk via the liquid in the common liquid chamber 23. Furthermore, there is little possibility of occurrence of crosstalk due to deformation of the base plate 14 constituting the side wall of the pressure chamber 16 drawn by the opposing wall 13*a*. Considering an effect on preventing deformation of the opposing wall 13*a*, the reinforcing portion 1 is increased in size, but excessive resistance to the flow of the liquid in the common liquid chamber 23 is undesirable. For that reason, the reinforcing portion 1 preferably have, in plan view, substantially a length of half the length of the pressure chamber 16 in the longitudinal direction of the pressure chamber 16, more preferably at least half, and a length equal to the length of the pressure chamber 16 in the crosswise direction of the pressure chamber 16. Deformation of the opposing wall 13*a* at a position close to the ejection port 15 particularly has a great influence on the performance of liquid ejection. Accordingly, the reinforcing portion 1 may be disposed at a position nearer to the ejection port 15 than the center of the pressure chamber 16. More specifically, the center of gravity of the reinforcing portion 1 is nearer to the ejection port 15 than the center of gravity of the pressure chamber 16.

Piezoelectric Actuator

Figure 6:
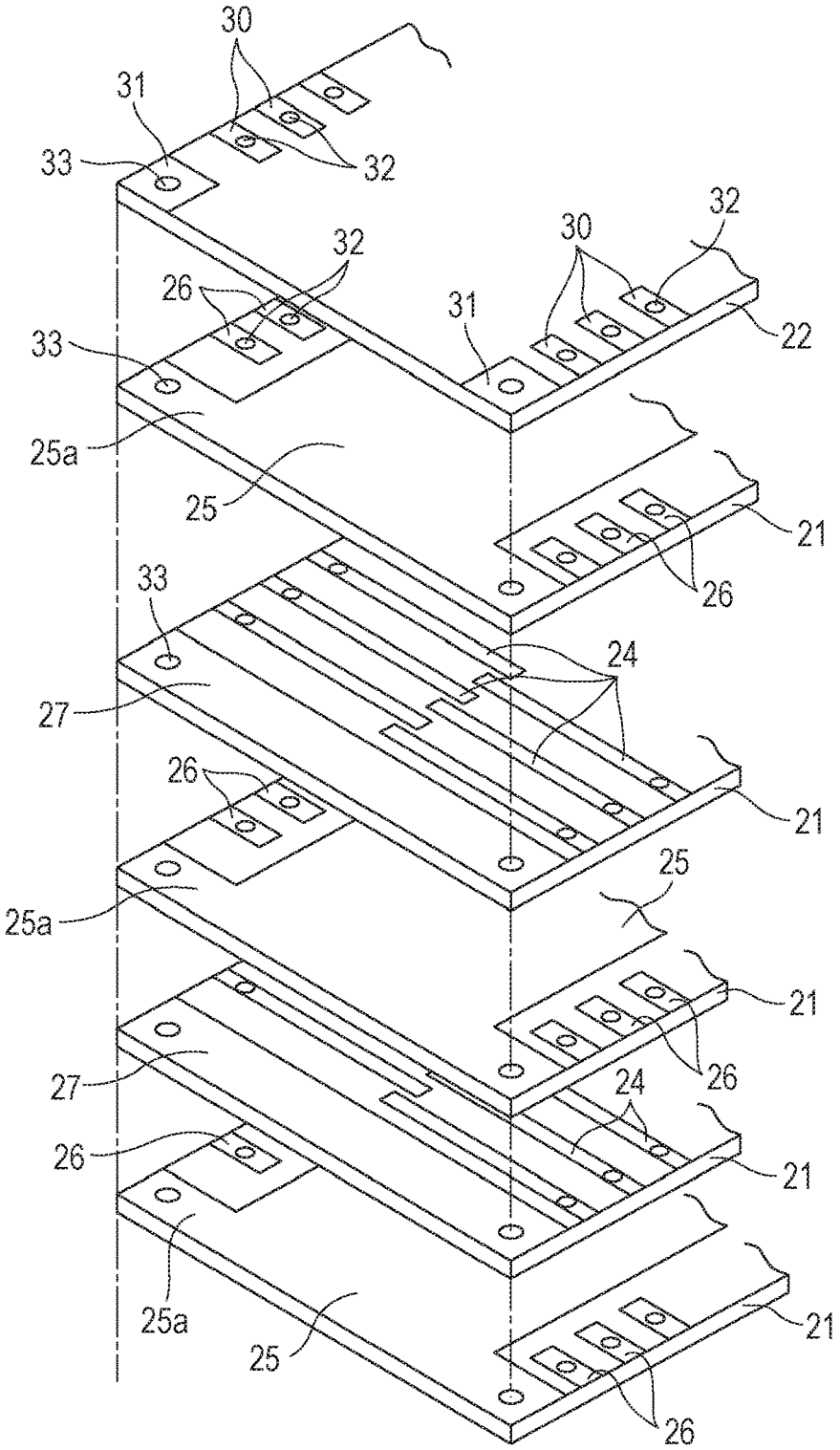
FIG. 6 is an exploded perspective view of the piezoelectric actuator of the liquid ejection head in FIG. 1.

The piezoelectric actuator 20 of the present embodiment described above will be described. The piezoelectric actuator 20 has a configuration in which a plurality of piezoelectric layers and electrode layers are alternately laminated. The piezoelectric layers are each formed of a piezoelectric sheet 21 made of piezoelectric ceramic with a thickness of about 30 μm. As illustrated in FIG. 6, the piezoelectric actuator 20 has a structure in which the plurality of piezoelectric sheets 21 are layered, on the uppermost surface of which a top sheet 22 is laminated. Each electrode layer is formed on the upper surface (a wide surface) of each piezoelectric sheet 21 as an electrode pattern made of metal film, as will be described below. Of the plurality of piezoelectric sheets 21, a plurality of piezoelectric sheets 21 adjacent to the substrate 10 (on the lower side) constitute an active layer including an active portion that can be expanded and contracted in correspondence with the pressure chambers 16. The plurality of piezoelectric sheets 21 on the upper side may constitute a constraint layer including a constraint portion that constrains upward expansion and contraction of the active portion. In the active layer, the electrode layers each sandwiched between the piezoelectric layers, that is, individual electrodes 24 provided in correspondence with the pressure chambers 16 to selectively apply a voltage and a common electrode 25 having a wide shape extending across the plurality of pressure chambers 16 and having a common polarity, are alternately formed in the laminating direction. Specifically, the individual electrodes 24 are formed on the upper surface of each even-numbered piezoelectric sheet 21 counted from the lowermost piezoelectric sheet 21, and the common electrode 25 is formed on the upper surface of each odd-numbered piezoelectric sheet 2 counted from the lowermost piezoelectric sheet 21. Extending portions 25*a* extending across substantially the entire length of the vicinity of the short sides of the piezoelectric sheet 21 having the common electrode 25 are formed on both ends on the long sides of the piezoelectric sheet 21 and are connected to the common electrode 25. On each piezoelectric sheet 21 on which the common electrode 25 is formed, dummy individual electrodes 26 are formed at the same positions in plan view (vertically overlapping positions) as the positions of the individual electrodes 24 on the upper surface of the vicinity of the ends of the long sides where the common electrode 25 is not formed. The dummy individual electrodes 26 are substantially equal in width to the individual electrodes 24 and shorter in length than the individual electrodes 24. Dummy common electrodes 27 are formed at positions on the upper surface of each piezoelectric sheet 21 on which the individual electrodes 24 are formed, the positions corresponding to the extending portions 25*a* (vertically overlapping positions, in the vicinity of both ends of the long sides of the piezoelectric sheet 21). The individual electrodes 24, the common electrodes 25, the dummy individual electrodes 26, and the dummy common electrodes 27 are formed at predetermined portions in predetermined patterns by screen printing an electrically conductive paste made of an alloy of silver and palladium. Surface electrodes 30 and 31 are formed by printing on the upper surface of the top sheet 22, on which an electrical wiring member 40 are placed and joined, and various kinds of wiring pattern (not shown) of the electrical wiring member 40 are electrically connected to the surface electrodes 30 and 31.

All of piezoelectric sheets 21 of the piezoelectric actuator 20 other than the lowermost piezoelectric sheet 21 have through holes 32 for connecting the surface electrodes 30, the individual electrodes 24 and the dummy individual electrodes 26 at corresponding positions in plan view together. Likewise, a through hole 33 for connecting at least one surface electrode 31 and the extending portion 25*a* of the common electrode 25 and the dummy common electrode 27 at a corresponding position in plan view is provided. In the illustrated embodiment, the through hole 33 is formed in the surface electrodes 31 at the four corners of the uppermost piezoelectric sheet 21 and the extending portion 25*a* of the common electrode 25 and the dummy common electrode 27 at a corresponding position in plan view. The interior of the through holes 32 is filled with an electrically conductive material to electrically connect the individual electrodes 24 of the individual layers and the surface electrodes 30 at corresponding positions in plan view. Likewise, the interior of the through holes 33 is filled with an electrically conductive material to electrically connect the extending portions 25*a* of the individual layers and the surface electrode 31 at the corresponding position in plan view. In an actual manufacturing process, the through holes 32 and 33 are formed in a ceramic green sheet constituting each piezoelectric sheet 21, and an electrically conductive paste made of an alloy of silver and palladium is applied to the green sheet by screen printing or the like to form electrode patterns. At that time, the electrically conductive material forming the electrode patterns enters the interior of the through holes 32 and 33 and fills them. This allows the upper and lower surfaces of the piezoelectric sheets 21 to be electrically conducted through the through holes 32 and 33. The piezoelectric sheets 21 are laminated so that the electrode patterns or the dummy electrodes of the lower layers and the through holes 32 and 33 of the upper layers are aligned and are pressed in the laminating direction to form a single unit, and it is burned as is well known to form the piezoelectric actuator 20.

As described above, the through holes 32 and 33 of the piezoelectric layers sandwiched between the individual electrodes 24 and the common electrode 25 are filled with an electrically conductive material. As is well known, when the common electrodes 25 are grounded, and a positive high voltage for polarization is applied to all of the individual electrodes 24, an area of each piezoelectric sheet 21 between the electrodes is polarized in a direction from the individual electrodes 24 to the common electrode 25 to form an active portion. In other words, the second piezoelectric sheet 21 counted from the bottom to the uppermost piezoelectric sheet 21 constitute the active layer. When a driving positive low voltage is selectively applied to the individual electrodes 24 with the common electrodes 25 grounded, the active portion is extended due to a piezoelectric longitudinal effect. Thus, distortion in the laminating direction occurs in the piezoelectric layers sandwiched between the individual electrodes 24 and each common electrode 25. The amount of displacement due to the distortion increases toward the interior of the pressure chamber 16 corresponding to each individual electrode 24, which reduces the capacity of the pressure chamber 16, so that the liquid in the pressure chamber 16 is ejected as droplets from the ejection port 15 to the outside. The thus-ejected droplets are attached to a desired position of a printing medium (not shown) to perform desired recording (image formation or printing).

First Embodiment

More concrete embodiments of the present disclosure will be described. In the following description, only the characteristics of the embodiments will be described, and description of configurations similar to those already described will be omitted.

In a first embodiment of the present disclosure, as illustrated in FIGS. 3 to 5, the upper manifold plate 12*a* has recesses 23*a* that are open only downward, and the lower manifold plate 12*b* has the recesses 23*b* that are open only upward. The manifold plates 12*a* and 12*b* are laminated so that the recesses 23*a* and 23*b* face each other to form the common liquid chamber 23. The common liquid chamber 23 (recesses 23*a* and 23*b*) is provided with the reinforcing portions 1 therein at positions of the manifold plates 12*a* and 12*b* where the through holes 18 are not closed and which overlap with the pressure chambers 16 in the laminating direction. The reinforcing portions 1 are structures that suppress deformation of the opposing wall 13*a* to allow liquid ejection with high energy efficiency and that contribute to suppress the occurrence of crosstalk. In the present embodiment, the reinforcing portions 1 are provided in each of the recesses 23*a* and 23*b*, and the protrusions 12*d* that are joined together to constitute each reinforcing portion 1 have the same shape.

Second Embodiment

Figure 7:
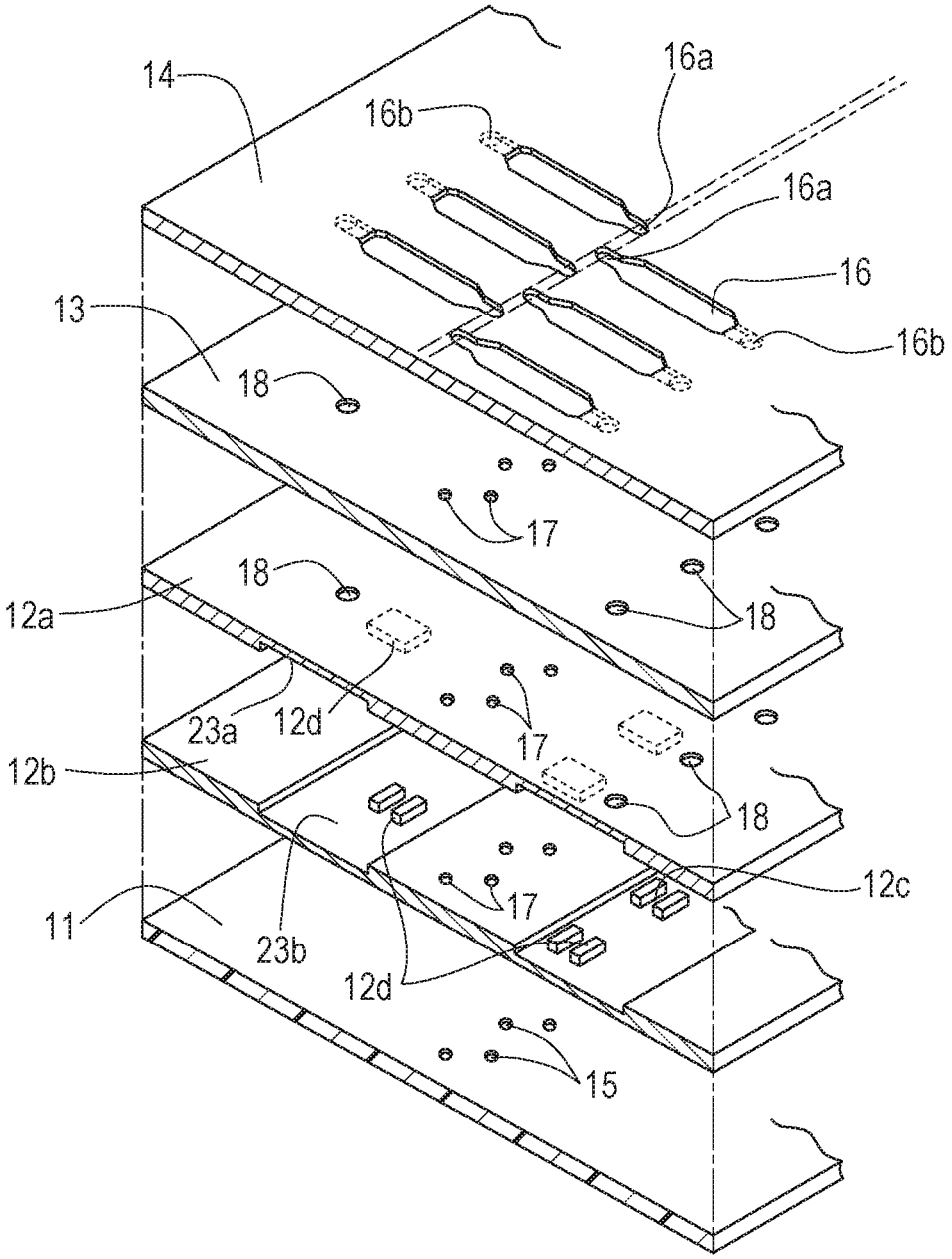
FIG. 7 is a partly cut-away exploded perspective view of a substrate of a liquid ejection head according to a second embodiment of the present disclosure.
Figure 8:
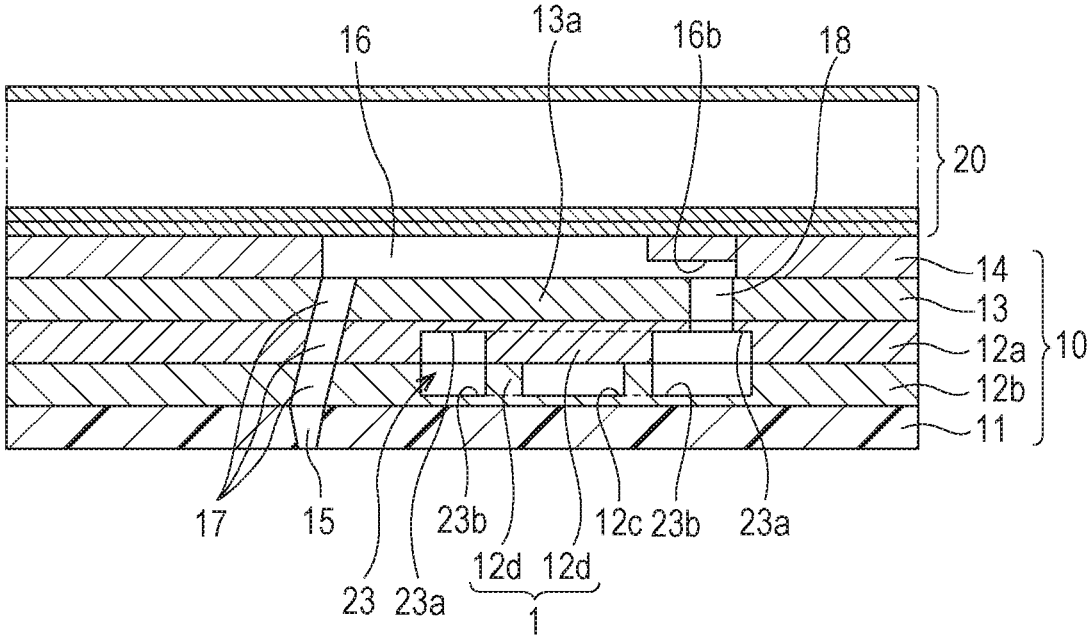
FIG. 8 is a cross-sectional view of the liquid ejection head according to the second embodiment.

In a second embodiment of the present disclosure, as illustrated in FIGS. 7 and 8, the protrusions 12*d* in the recess 23*b* of the lower manifold plate 12*b* each have a groove 12*c* extending in the longitudinal direction of the common liquid chamber 23. In this configuration, the groove 12*c* provided in each protrusion 12*d* serves as a passage of the liquid, which allows the entire common liquid chamber 23 to be smoothly filled with the liquid, which produces a small pressure loss in the common liquid chamber 23, leading to good liquid supply performance. The groove 12*c* may be disposed in each protrusion 12*d* in the recess 23*a* of the upper manifold plate 12*a*. To further reduce the pressure loss, the groove 12*c* may be disposed in the protrusions 12*d* of both of the recesses 23*a* and 23*b*. In other words, the present embodiment has the groove 12*c* in one or both of the protrusions 12*d* in the recesses 23*a* and 23*b*.

Third Embodiment

Figure 9:
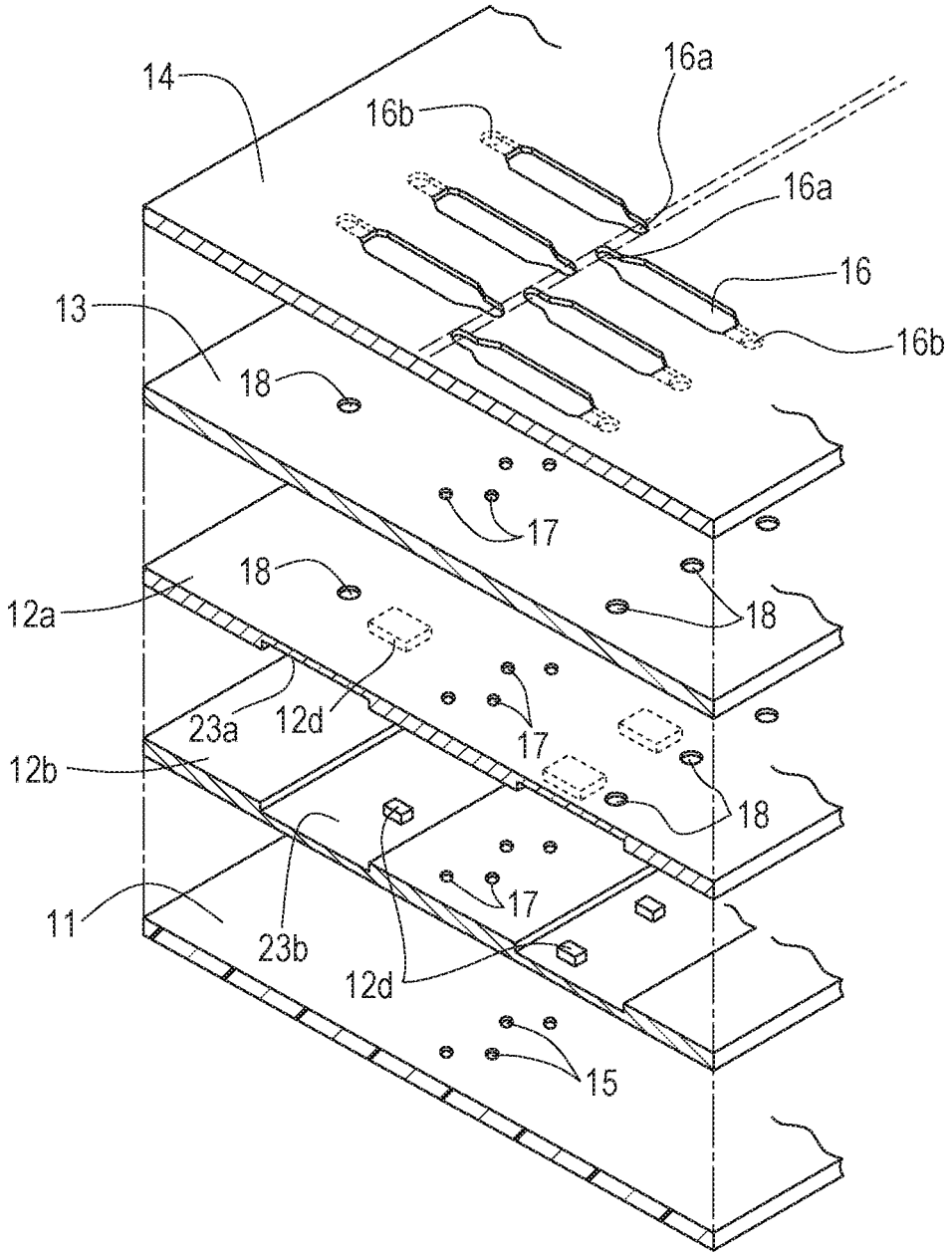
FIG. 9 is a partly cut-away exploded perspective view of a substrate of a liquid ejection head according to a third embodiment of the present disclosure.
Figure 10:
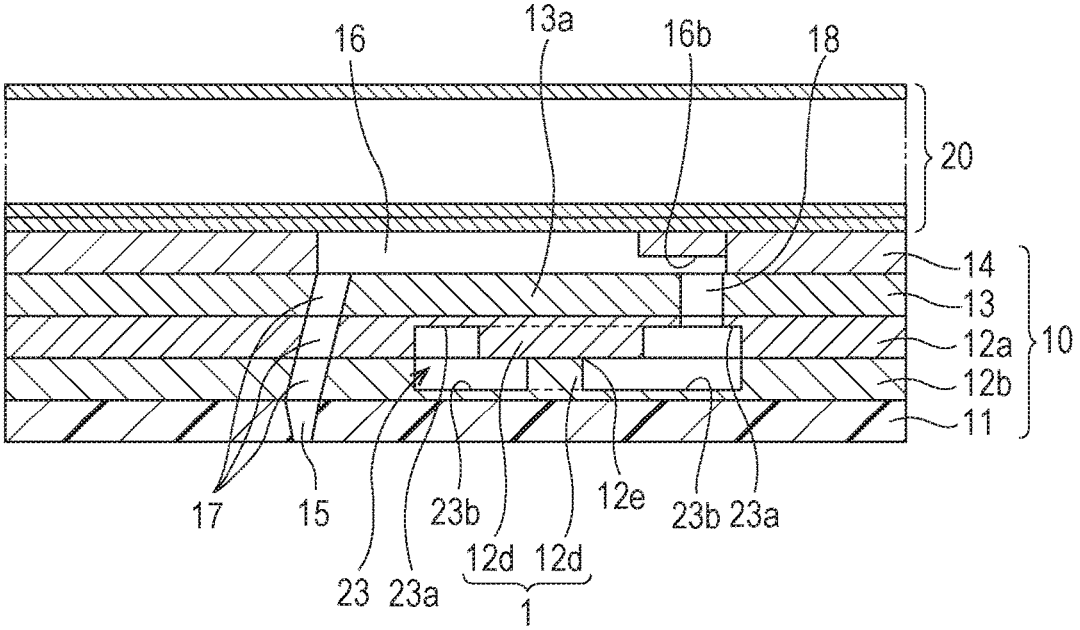
FIG. 10 is a cross-sectional view of the liquid ejection head according to the third embodiment.

In a third embodiment of the present disclosure, as illustrated in FIGS. 9 and 10, the protrusion 12*d* in the recess 23*b* of the lower manifold plate 12*b* is smaller in planar shape than the protrusion 12*d* in the recess 23*a* of the upper manifold plate 12*a*. In this configuration, the upper protrusion 12*d* and the lower protrusion 12*d* whose ends are in contact with each other to form a step portion 12*e*. The step portion 12*e* serves as a passage of the liquid, which allows the entire common liquid chamber 23 to be smoothly filled with the liquid, which produces a small pressure loss in the common liquid chamber 23, leading to good liquid supply performance. This configuration also facilitates bonding of the manifold plates 12*a* and 12*b* including the recesses 23*a* and 23*b* together. Alternatively, the step portion may be formed by a structure in which the protrusion 12*d* in the recess 23*b* of the lower manifold plate 12*b* is larger in plan view than the protrusion 12*d* in the recess 23*a* of the manifold plate 12*a*. In other words, in the present embodiment, one of the protrusions 12*d* in the recesses 23*a* and 23*b* is smaller in planar shape than the other, and the step portion 12*e* is formed by both of the protrusions 12*d*.

Fourth Embodiment

Figure 11:
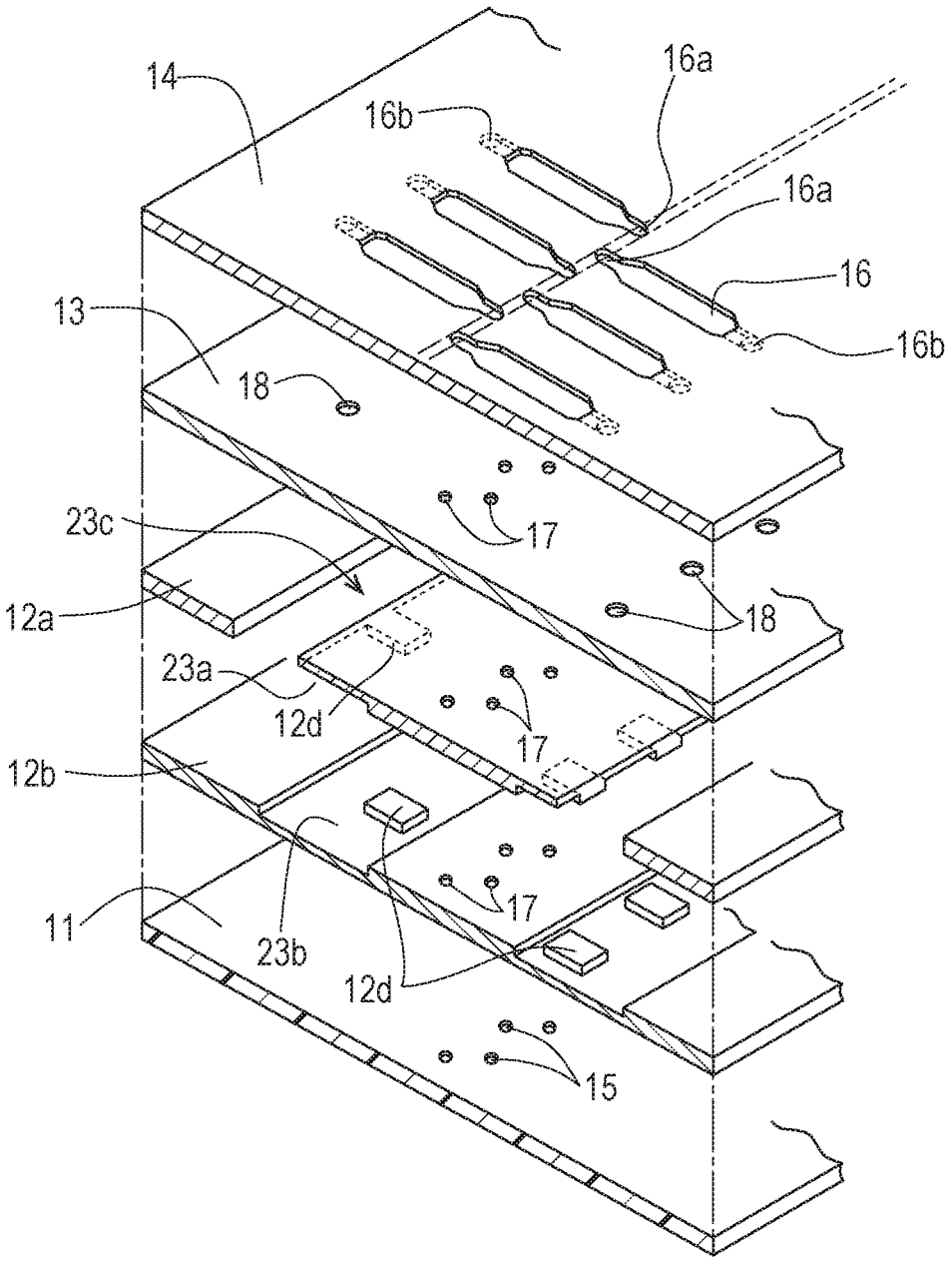
FIG. 11 is a partly cut-away exploded perspective view of a substrate of a liquid ejection head according to a fourth embodiment of the present disclosure.
Figure 12:
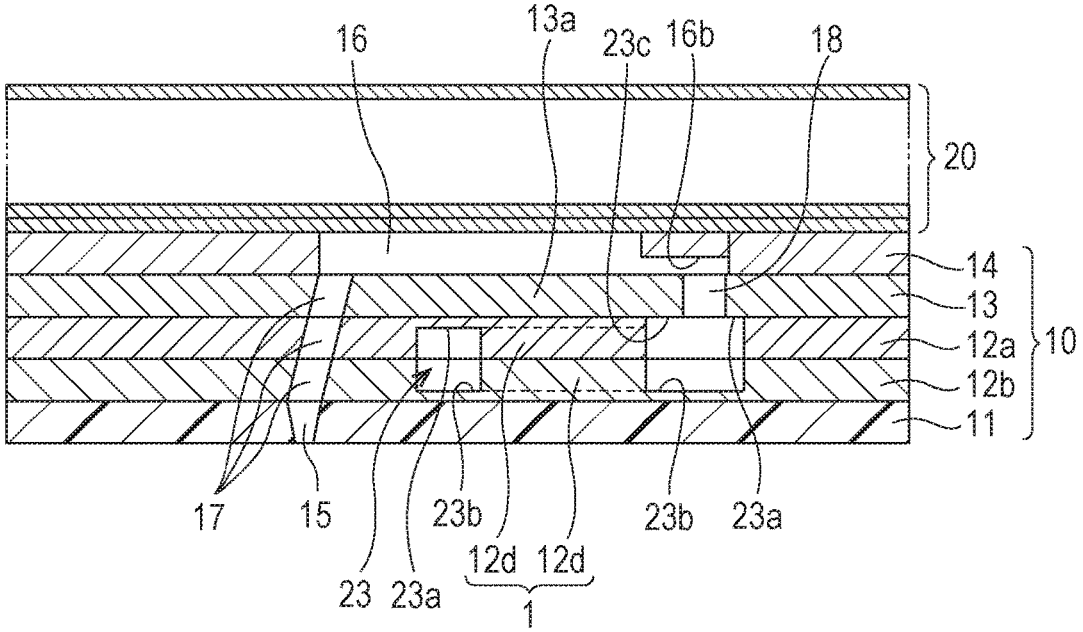
FIG. 12 is a cross-sectional view of the liquid ejection head according to the fourth embodiment.

In a fourth embodiment of the present disclosure, as illustrated in FIGS. 11 and 12, the shape of the reinforcing portion 1 is the same as that in the first embodiment, but part of the recess 23*a* of the upper manifold plate 12*a* is a slit-like opening 23*c* passing through the manifold plate 12*a*. The opening 23*c* has such a shape that the through holes 18 illustrated in FIG. 7 are substantially widened and extend in the longitudinal direction of the common liquid chamber 23. The opposing wall 13*a* constitutes part of the walls of the common liquid chamber 23 at the position of the opening. This configuration increases the capacity of the common liquid chamber 23, which reduces pressure loss, enhancing the liquid supply performance.

Fifth Embodiment

Figure 13:
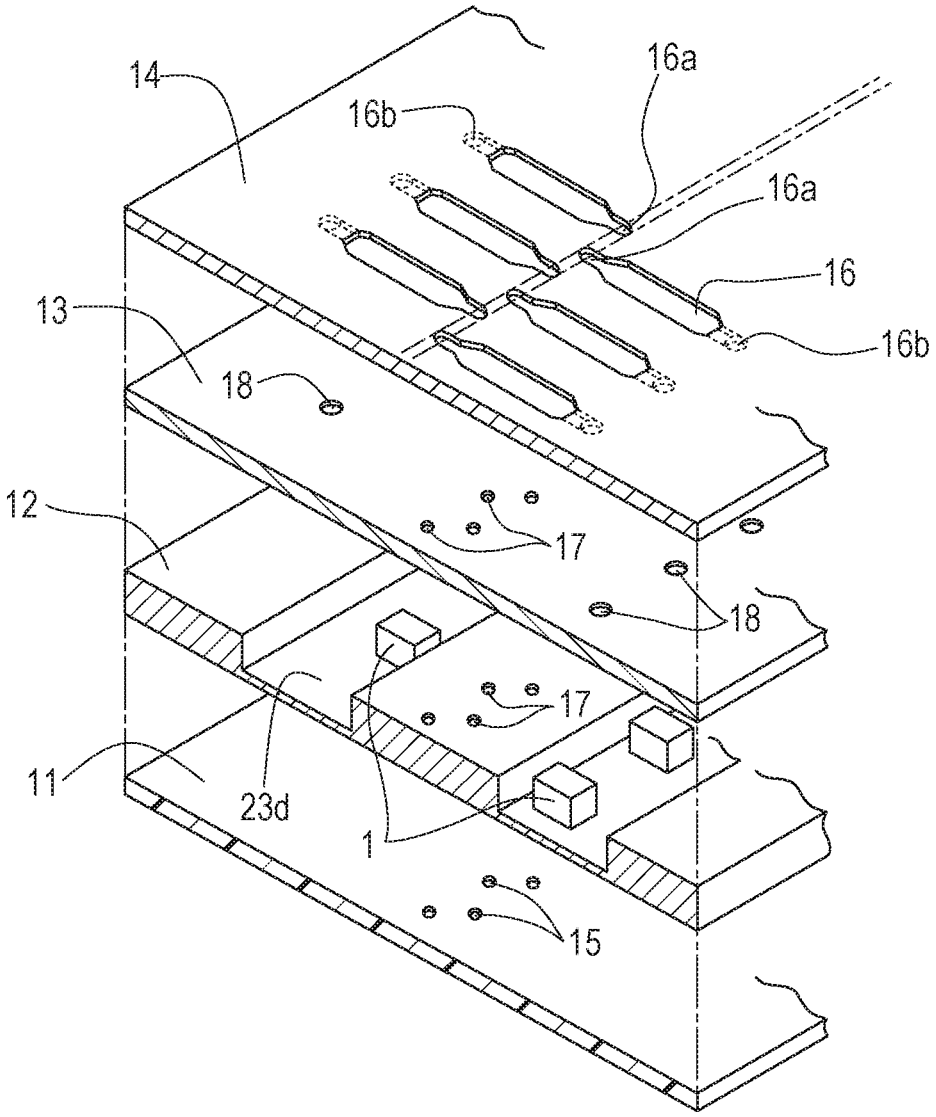
FIG. 13 is a partly cut-away exploded perspective view of a substrate of a liquid ejection head according to a fifth embodiment of the present disclosure.
Figure 14:
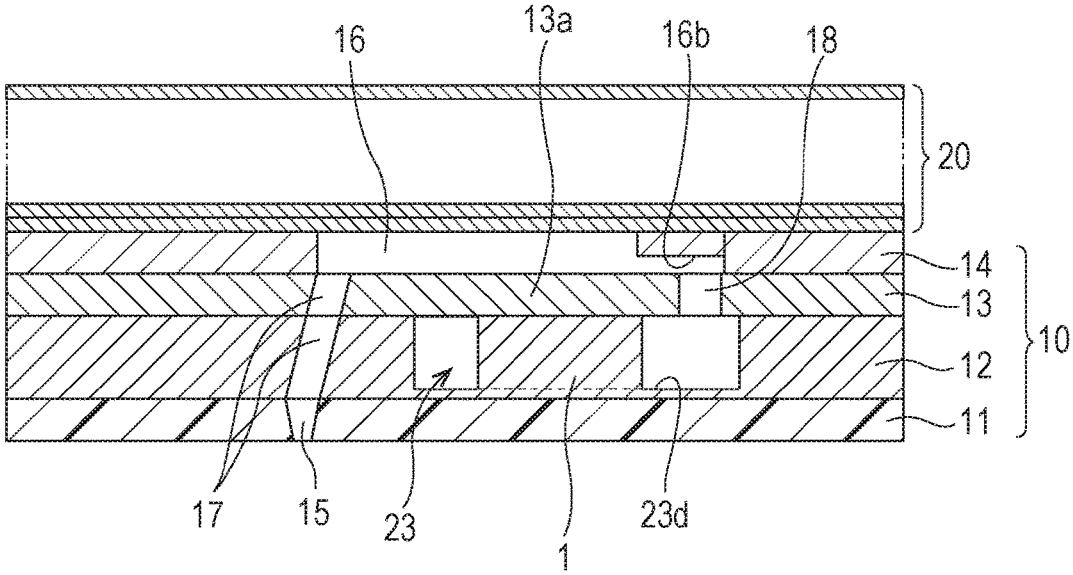
FIG. 14 is a cross-sectional view of the liquid ejection head according to the fifth embodiment.

In a fifth embodiment of the present disclosure, as illustrated in FIGS. 13 and 14, only one manifold plate 12 is disposed between the spacer plate 13 and the ejection port plate 11. The manifold plate 12 has recesses 23*d* that are open from the upper surface. The recesses 23*d* are covered by the spacer plate 13 (the opposing wall 13*a*) to form the common liquid chamber 23. Each recess 23*d* is provided with protruding reinforcing portions 1 protruding toward the spacer plate 13. An end of each reinforcing portion 1 is in contact with the opposing wall 13*a* and joined thereto. The manifold plate 12 of the present embodiment has a thickness substantially twice the thickness of each of the manifold plates 12*a* and 12*b* of the first embodiment. The common liquid chamber 23 of the present embodiment has a capacity equal to or larger than of the capacity of the common liquid chamber 23 of the first embodiment. In this configuration, the spacer plate 13 directly faces the common liquid chamber 23, and part (the thin-wall portion) of the manifold plate 12 is not interposed between the spacer plate 13 and the common liquid chamber 23 unlike the first embodiment. This increases the capacity of the common liquid chamber 23 and reduces pressure loss, thereby increasing the liquid supply performance. Since only one manifold plate 12 is used, the number of components is decreased, thereby reducing the cost.

The liquid ejection head according to an embodiment of the present disclosure allows high-accuracy liquid ejection with high energy efficiency.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-173601 filed Sep. 6, 2016, which is hereby incorporated by reference herein in its entirety.

What is claimed is:

1. A liquid ejection head comprising:

a plurality of ejection ports;

a plurality of pressure chambers each communicating with each of the ejection ports;

a piezoelectric actuator constituting part of walls of the pressure chambers;

a common liquid chamber for containing liquid to be supplied to the plurality of pressure chambers;

an opposing wall interposed between the pressure chambers and the common liquid chamber, the opposing wall having an upper surface functioning as one of the walls of the pressure chambers; and a reinforcing portion having at least one sidewall interconnecting an upper surface and lower surface of the common liquid chamber that supports a lower surface of the opposing wall, wherein the pressure chambers and the common liquid chamber are arranged in an opposing configuration with respect to each other, wherein the common liquid chamber is provided in a first manifold plate and a second manifold plate, wherein the reinforcing portion includes a first reinforcing portion provided in the first manifold plate and a second reinforcing portion provided in the second manifold plate, and the first reinforcing portion and the second reinforcing portion are in contact with each other.

2. The liquid ejection head according to claim 1, wherein the pressure chambers are disposed such that their longitudinal direction crosses a longitudinal direction of the common liquid chamber, and wherein the reinforcing portion has a length at least half of a length of each pressure chamber in the longitudinal direction of the pressure chambers and has a length equal to the length of each pressure chamber in a crosswise direction of the pressure chamber.

3. The liquid ejection head according to claim 1, wherein the reinforcing portion is disposed at a position nearer to each ejection port than a center of each pressure chamber.

4. The liquid ejection head according to claim 1, wherein the protrusions disposed in the respective recesses have same shapes as each other.

5. The liquid ejection head according to claim 1, wherein one or both of the protrusions provided in the respective recesses have a groove.

6. The liquid ejection head according to claim 1, wherein one of the protrusions provided in the respective recesses is smaller in planar shape than another, and wherein the protrusions form a step portion.

7. The liquid ejection head according to claim 1, wherein one of the two laminated plates nearer to the pressure chambers has an opening constituting part of the recess, and wherein the opposing wall constitutes part of a wall of the common liquid chamber at a position of the opening.

8. The liquid ejection head according to claim 7, wherein the opening constituting part of the recess comprises a slit extending in a longitudinal direction of the common liquid chamber.

9. The liquid ejection head according to claim 1, wherein the common liquid chamber is formed by a recess formed in a plate being covered by the opposing wall, wherein the recess is provided with the reinforcing portion, and wherein an end of the reinforcing portion is in contact with the opposing wall.

* * * * *